US009603232B2

(12) United States Patent
Chabert

(10) Patent No.: US 9,603,232 B2
(45) Date of Patent: Mar. 21, 2017

(54) ELECTRONEGATIVE PLASMA MOTOR

(75) Inventor: Pascal Chabert, Paris (FR)

(73) Assignees: ECOLE POLYTECHNIQUE, Palaiseau (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 1788 days.

(21) Appl. No.: 12/096,534

(22) PCT Filed: Dec. 6, 2006

(86) PCT No.: PCT/EP2006/069387

§ 371 (c)(1),
(2), (4) Date: Jun. 6, 2008

(87) PCT Pub. No.: WO2007/065915

PCT Pub. Date: Jun. 14, 2007

(65) Prior Publication Data

US 2008/0271430 A1 Nov. 6, 2008

(30) Foreign Application Priority Data

Dec. 7, 2005 (FR) ..... 05 12417

(51) Int. Cl.
*F03H 1/00* (2006.01)
*H05H 1/54* (2006.01)

(52) U.S. Cl.
CPC ..... *H05H 1/54* (2013.01); *F03H 1/0025* (2013.01); *F03H 1/0043* (2013.01)

(58) Field of Classification Search
USPC ..... 60/202
See application file for complete search history.

(56) References Cited

U.S. PATENT DOCUMENTS

| | | | | |
|---|---|---|---|---|
| 3,177,654 | A | 4/1965 | Gradecak | |
| 3,263,415 | A * | 8/1966 | Sunderland et al. | 60/202 |
| 6,609,363 | B1 | 8/2003 | Dressler et al. | |
| 6,996,972 | B2 * | 2/2006 | Song | 60/202 |
| 7,115,881 | B2 * | 10/2006 | Rabinowitz et al. | 250/423 R |
| 7,420,182 | B2 * | 9/2008 | Hruby et al. | 250/427 |
| 2006/0042224 | A1 | 3/2006 | Shiao et al. | |

OTHER PUBLICATIONS

J. Shiao et al.; "AIAA 2005-5385: The Dual-Plasma Jet Thrusters (With Electric Starters) by Using Dual-Plasma Fusion Fuel Cells As Their Power Source"; AIAA Paper, American Institute of Aeronautics and Astronautics, New York, US, No. 2005-5385, Jun. 2005 (Jun. 2005), p. 1-14, XP008069911.

* cited by examiner

*Primary Examiner* — Arun Goyal
(74) *Attorney, Agent, or Firm* — Hauptman Ham, LLP

(57) ABSTRACT

A plasma motor for extracting a positive ion flow has a single ionization stage and a device for supplying the ionization stage with an ionizable electronegative gas. The plasma motor further has a device for creating an electric field so as to produce the ionization of the gas in the ionization stage. The device for creating the electric filed includes a device for extracting a negative ion flow and, a device for extracting a positive ion flow, connected to the ionization stage. The extraction of a positive ion flow and the extraction of a negative ion flow are of the same amplitude, ensuring the electrical neutrality of the motor. The extraction of a positive ion flow and the extraction of a negative ion flow allow the neutrality of the motor to be ensured.

12 Claims, 2 Drawing Sheets

ELECTRONEGATIVE PLASMA MOTOR

CROSS-REFERENCE TO RELATED APPLICATIONS

The present Application is based on International Application No. PCT/EP2006/069387, filed on Dec. 6, 2006, which in turn corresponds to French Application No. 05 12417 filed on Dec. 7, 2005, and priority is hereby claimed under 35 USC §119 based on these applications. Each of these applications are hereby incorporated by reference in their entirety into the present application.

FIELD OF THE INVENTION

The invention is situated in the field of plasma motors. These motors may, for example, be used in satellites or spacecraft, the propulsion of which necessitates low thrusts for long periods, as for example probes.

BACKGROUND OF THE INVENTION

The propulsion of spacecraft in space (where terrestrial gravitation becomes negligible) requires low thrusts (low flow of ejected material), but high ejection speeds of "fuel" to minimize the on-board mass. In fact, the speed increase $\Delta u$ of a spacecraft is linked to the gas ejection speed $u_e$ and to the initial and final masses, $m_0$ and $m_f$, of fuel by the following equation, called the "rocket equation":

$$\Delta u = u_e \ln\left(\frac{m_0}{m_f}\right)$$

A high gas ejection speed is therefore imperative if it is desired to save fuel. Plasma motors allow these high ejection speeds to be attained. Two quantities are used to characterize a motor, the specific impulse:

$$I_s = \frac{u_e}{g_o}$$

expressed in seconds, where go is the gravity constant at the surface of the earth, and the thrust:

$$T = \dot{m} u_e$$

where $\dot{m}$ is the mass flow rate.

The principle of plasma motors, described in the illustrated schema of FIG. 1, is the following: the "fuel" (gas) X is first ionized in a plasma to form positive ions $X^+$ and electrons $e^-$, then ejected by being accelerated in an electric field E (often created by accelerating grids), before being neutralized by an additional electron beam $Fe^-$ positioned downstream of the acceleration zone. The neutralization is indispensable to prevent the spacecraft becoming electrically charged.

The various prototypes of plasma motors existing to date use, generally speaking, an ionization stage to generate a source of positively charged matter (positive ions), an acceleration stage and a neutralization structure. The ionization sources and the accelerating and neutralizing structures may be varied. But all the motors existing to date use only positively charged matter (positive ions) for propulsion, the negative charge (the electrons) serving solely for the ionization and the neutralization.

SUMMARY OF THE INVENTION

In this context, the main proposal in the present invention is to use a flow of positive ions and a flow of negative ions for the thrust. To do this, an electronegative gas (gas with a high electron affinity) is used as a fuel.

The thrust is therefore ensured by two types of ions, one of the types being positively charged, the other negatively. These ion beams neutralize each other (for example, by recombination) downstream to form a beam of fast neutral molecules, which allows a neutralization structure downstream of the acceleration to be dispensed with.

More precisely, the subject of the present invention is a plasma motor comprising the extraction of a positive ion flow, characterized in that it comprises:

- a single ionization stage;
- means of supplying said ionization stage with an ionizable electronegative gas;
- means for creating an electric field so as to produce the ionization of the gas in the ionization stage;
- first means for extracting a negative ion flow, second means for extracting a positive ion flow, connected to the ionization stage; and
- the extraction of a positive ion flow and the extraction of a negative ion flow of the same amplitude, ensuring the electrical neutrality of the motor.

The interest of the invention resides notably in the use of a single ionization stage and a single ionizable gas, allowing a negative ion flow and a positive ion flow of the same amplitude to be delivered.

Advantageously, the plasma motor according to the invention may furthermore comprise means for filtering the electrons freed in the ionization stage, during the ionization of the gas.

Advantageously, the plasma motor may comprise ion flow extraction means comprising at least one polarized grid.

Advantageously, the plasma motor may comprise means for creating an electric field comprising two conductor elements placed at the ends of the ionization stage to apply a voltage to said stage, or comprising a coil powered by a radiofrequency current.

The means for creating an electric field may also be of the helicon antenna type powered by a radiofrequency current.

According to a variant of the invention, the electronegative gas may be diiodine.

According to a variant of the invention, the electronegative gas may be oxygen.

According to a variant of the invention, the plasma motor may comprise means for creating an alternating field generating a pulsed plasma (alternation of on/off periods) allowing the extraction of ion flows during the off period, a period during which the electrons have disappeared (temporal filter of the electrons).

The plasma motor may advantageously comprise means for generating a static magnetic field within the ionization stage so as to filter the electrons in a steady state (spatial filter).

These means may be permanent magnets placed at the periphery of the ionization stage to create the magnetic field within said ionization stage.

According to a variant of the invention, the plasma motor may comprise means for extracting the negative and positive ion flows in a direction perpendicular to the direction of the magnetic field applied at the ionization stage. In this case, the plasma motor may advantageously comprise a cylinder constituting the ionization stage and at least one peripheral extraction stage mounted on said cylinder and equipped on the surface with polarized grids.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE INVENTION

Figure 1:
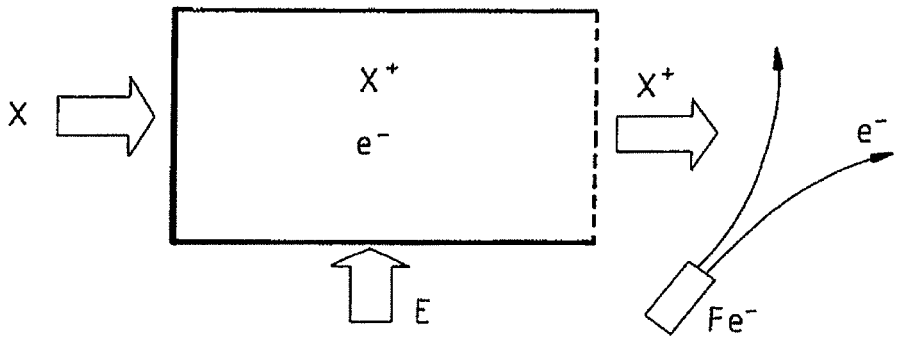
FIG.1 (PRIOR ART)
FIG. 1 schematizes a plasma motor according to the prior art comprising the propulsion of a positive gas accompanied by a neutralizer.
Figure 2:
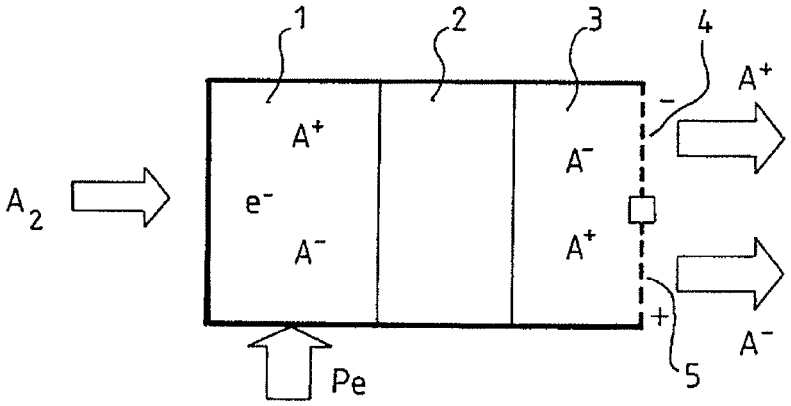
FIG. 2 schematizes an example of a motor according to the invention comprising an electronegative gas for simultaneously generating a positive ion flow and a negative ion flow.

In the example described below, the motor according to the invention comprises a structure supplied with electronegative gas as schematized in FIG. 2 and comprising:

an ionization stage 1;

a filtering stage 2; and an extraction stage 3.

A flow of electronegative gas $A_2$ is introduced into the ionization stage 1. Under the action of a magnetic field, schematized by the arrow representing the electrical power Pe, the electronegative gas generates positive ions $A^+$, negative ions $A^-$ and electrons $e^-$. The ionization stage is connected to a stage 2 of filtering the electrons in such a way as to make available in the extraction stage 3 a plasma of positive ions and of negative ions lacking electrons due to the filtering means, which may, for example, be a static magnetic field. Extraction of the plasma is ensured in the case schematized here by two grids, polarized negatively 4 and positively 5.

The thrust is therefore ensured by the two types of ions (the negative charge and the positive charge). The neutralization downstream is no longer necessary because the beams of ions neutralize each other downstream (recombination) to form a beam of fast neutral molecules.

The ionization stage 1 may use any type of connection of the electrical energy to the plasma (for example, two plates continuously polarized at low frequency or at radiofrequency, a coil powered at radiofrequency for inductive coupling, or a microwave source).

The filtering stage 2 may be produced in at least two ways:

(i) by adjusting the creation of the plasma (pulsed plasmas: on/off alternation of the electrical power) and by using the off period for extraction, a period during which the electrons have disappeared by attaching to the molecules. According to this configuration, the ionization and filtering stages are common;

(ii) by using a static magnetic field to trap the electrons that have a much lower Larmor radius due to the ratio of their respective masses. The Larmor radius is proportional to the mass of particles; it is written:

$$R_L = \frac{m_{e,i} u_{e,i}}{eB}$$

where $m_{e,i}$ and $u_{e,i}$ are the mass and the speed respectively of the electrons or ions, e is the elementary charge, and B the amplitude of the magnetic field.

The extraction stage 3 may consist of accelerating grids, the dimensions of which are not necessarily similar to those of motors with a conventional grid, because the charge sheath properties of space are different in the absence of electrons.

Figure 3:
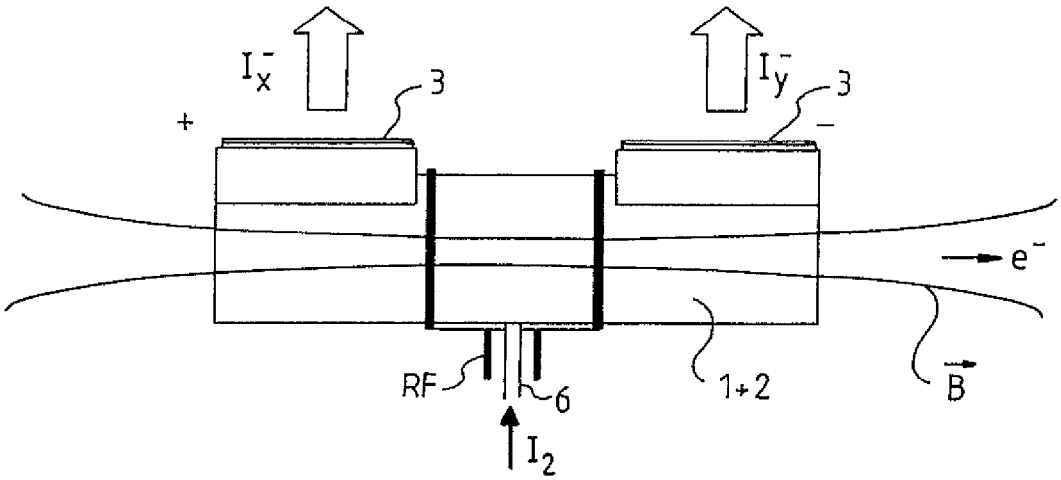
FIG. 3 illustrates an example of a motor according to the invention, having two extraction grids, polarized positively and negatively.

FIG. 3 illustrates an example of a possible prototype which is only one example among the possible prototypes.

The system comprises a horizontal cylinder: the ionization stage 1, where the dense plasma is generated by applying a radiofrequency voltage at 13.56 MHz to a helicon antenna, represented by the abbreviation RF. Helicon sources are known for producing very effective ionization. This cylinder furthermore comprises means 6 for introducing ionizable gas into the ionization stage. The diiodine $I_2$ is used as fuel. This is a highly electronegative gas allowing the formation of a large quantity of heavy negative ions (the higher the mass, the greater the thrust; the mass of $I_2$ is 254 AMU (Atomic Mass Units)). Furthermore, the ionization threshold of diiodine is low (10.5 eV to form $I^+$), which favors the formation of positive ions at low energy cost. However, a priori any electronegative gas may be used (for example, oxygen). A static magnetic field B with an intensity of around 0.01-0.1 Tesla is applied in the source cylinder, allowing the electrons to be confined in the cylinder, as shown in FIG. 3. The magnetic field may be generated by circulating a direct current through the coils or by permanent magnets (positioned at the periphery of the cylinder and not shown).

This magnetic field has two functions:

(i) to increase the ionization efficiency thanks to better electron confinement and better heating of the plasma by the helicon wave; and (ii) to create the magnetic filter for the electrons, i.e. to "magnetize" the electrons, to prevent them from diffusing into the ionic extraction stages 3.

These stages may typically be equipped with polarized grids, as shown in FIG. 3, in order to generate on one side a negative ion flow $I_x^-$ and a positive ion flow $I_y^+$. The positive and negative ions generated in the ionization stage (the horizontal cylinder) diffuse radially into the extraction stages because, in contrast to the electrons, they are not magnetized (the magnetic field is fairly weak and their mass is very high, with the result that their Larmor radius is far greater than the radius of the cylinder).

Figure 4:
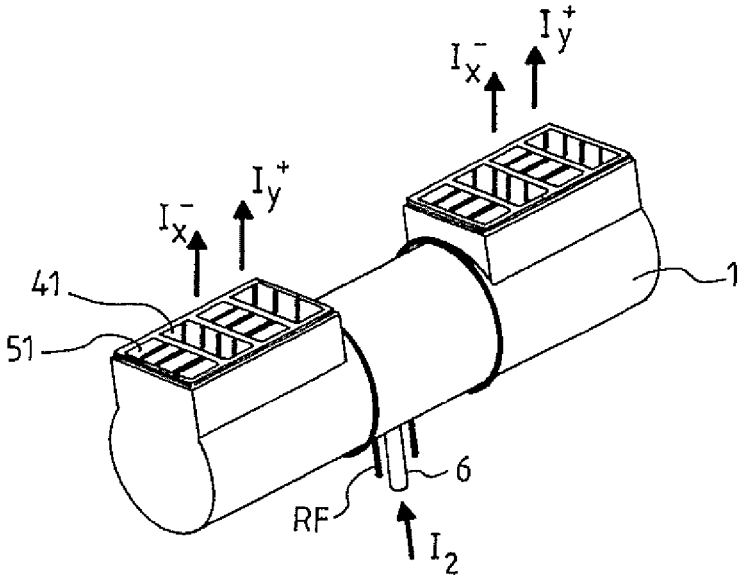
FIG. 4 illustrates a perspective view of a variant of the extraction stage comprising pairs of positively and negatively polarized grids, according to an example of a motor similar to that illustrated in FIG. 3.

According to a variant of the invention, the extraction stages 3 illustrated in perspective in FIG. 4 may also operate with pairs of grids 41 and 51 (the system illustrated in the figures has four pairs, two on each side); one of them is negatively polarized to accelerate the positive ions, the other is positively polarized to accelerate the negative ions. Note that the extraction areas may have different geometric forms; any geometry is conceivable and will seek to maximize the extraction surface.

Finally, the two extracted ion beams, with opposite signs, neutralize each other downstream (in space). Neutralization is therefore automatic and does not require an additional electron beam. The two beams may also recombine to form a beam of fast neutral molecules.

Typically, with a motor having an overall extraction area of around 500 $cm^2$, an acceleration voltage of 1000 V (obtained by polarizing the extraction grids so as to optimize the ionic optics), it is possible to obtain an ionic current density of 10 $mA/cm^2$, and hence a total extracted current of 5 A. Taking the mass of iodine, this current corresponds to a mass flow rate of ejected fuel of 6.5 mg/s. By considering an acceleration voltage of 1000 V, the ejection speed of the ions will be 40 km/s. Referring to the equations presented in the introduction, this mass flow rate and this ejection speed lead to the following performance: a thrust of 250 mN for a specific impulse of 4000 s.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A plasma motor for extracting a positive ion flow, said plasma motor comprising:

a single ionization stage configured to generate eleotrons by an ionizable electronegative gas introduced into the ionization stage;

a filtering stage connected to the ionization stale; and an extraction stage connected to the filtering stage and including (i) a first device for extracting a negative on flow, wherein the first device is positively polarized to accelerate a negative ion flow, and (ii) a second device for extracting a positive ion flow, wherein the second device is negatively polarized to accelerate the positive ion flow, wherein the positive ion flow and the negative ion flow have a same amplitude thereby ensuring an electrical neutrality of the motor; and the filtering stage comprises a third device for filtering the electrons, which are freed in the ionization stage, during ionization of the electronegative gas.

2. The plasma motor as claimed in claim 1, wherein the extraction stage for extracting the negative and positive ion flows comprises at least one polarized grid.

3. The plasma motor as claimed in claim 1, wherein the filtering stage comprises two conductor elements paced at ends of the ionization stage to apply a voltage to said ionization stage.

4. The plasma motor as claimed in claim 1, wherein the filtering stage comprises a coil powered by a radiofrequency current.

5. The plasma motor as claimed in claim 1, wherein filtering stage comprises a helicon antenna powered by a radiofrequency current (RF).

6. The plasma motor as claimed in claim 1, wherein the electronegative gas is diiodine.

7. The plasma motor as claimed in claim 1, wherein the electronegative gas is oxygen.

8. The plasma motor as claimed in claim 1, wherein the third device is configured to create an alternating field generating a pulsed plasma allowing simultaneous extraction of ion flows in absence of an electric field and filtering of the electrons.

9. The plasma motor as claimed in claim 1, wherein the third device is configured to generate a static magnetic field within the ionization stage so as to filter the electrons.

10. The plasma motor as claimed in claim 9, further comprising permanent magnets placed at a periphery of the ionization stage to create the magnetic field within said ionization stage.

11. The plasma motor as claimed in claim 9, wherein the first device and the second device are configured to extract the negative and positive ion flows in a direction perpendicuiar to a direction of the magnetic field applied at the ionization stage.

12. The plasma motor as claimed in claim 11, wherein the ionization stage is configured in cylinder, at least one peripheral extraction stage mounted on said cylinder and equipped on a surface with positively and negatively polarized grids.

* * * * *